US008513891B2

(12) United States Patent
Hsieh

(10) Patent No.: US 8,513,891 B2
(45) Date of Patent: Aug. 20, 2013

(54) WIRELESS LIGHT CONTROL SYSTEM WITH CONTROL APPARATUS AND METHOD THEREOF

(75) Inventor: Chung-hsin Hsieh, Taipei (TW)

(73) Assignee: Dartpoint Technology Co., Ltd., Taipei (TW)

( * ) Notice: Subject to any disclaimer, the term of this patent is extended or adjusted under 35 U.S.C. 154(b) by 298 days.

(21) Appl. No.: 13/092,901

(22) Filed: Apr. 22, 2011

(65) Prior Publication Data

US 2011/0260652 A1 Oct. 27, 2011

(30) Foreign Application Priority Data

Apr. 22, 2010 (TW) ..... 99112689 A

(51) Int. Cl.
*H05B 37/02* (2006.01)
*H05B 39/04* (2006.01)
*H05B 41/36* (2006.01)

(52) U.S. Cl.
USPC ..... 315/149; 315/152; 315/155; 315/158

(58) Field of Classification Search
USPC ..... 315/129, 134, 149–159, 312
See application file for complete search history.

(56) References Cited

U.S. PATENT DOCUMENTS

2007/0229250 A1* 10/2007 Recker et al. ..... 340/531
2011/0285526 A1* 11/2011 Tanaka et al. ..... 340/514

* cited by examiner

*Primary Examiner* — Anh Tran
(74) *Attorney, Agent, or Firm* — Cheng-Ju Chiang

(57) ABSTRACT

A wireless light control system with control apparatus for stage lights and method thereof are described. The light control apparatus in the wireless light control system communicates with the wireless receiver via a wireless connection. The wireless transmitter transmits the light control command, the scene control command and the procedure control command to the wireless receiver wherein the light control command includes a lighting parameter, a lighting duration parameter, a brightness parameter and light color parameters so that the stage light modules can switches the lighting status, the lighting duration, the brightness and the light colors based on Digital Multiplex 512 (DMX512) of the light control standard protocol. Further, the wireless light control system effectively simplifies the control architecture of the stage light modules.

20 Claims, 5 Drawing Sheets

WIRELESS LIGHT CONTROL SYSTEM WITH CONTROL APPARATUS AND METHOD THEREOF

FIELD OF THE INVENTION

The present invention relates to a control system and method thereof, and more particularly relates to a wireless light control system with control apparatus and method thereof for controlling light effects, such as lighting on and off statuses, lighting on and off duration, brightness and colors, of the stage light modules.

BACKGROUND OF THE INVENTION

Conventionally, a light control desk utilizes a plurality of cables to connect stage lights and a console therebetween. However, these cables positioned on the ground of the stage platform are interlaced with related stage equipments disadvantageously so that the arrangements, e.g. positions and area, of stage lights are restricted. For example, it is required to place the cables by requiring strenuous effort, which increases the configuration complexity of stage lights. In other words, the installation tasks of stage lights are apparently limited to be inconvenient for the usage of the stage light. Specifically, the control of conventional stage lights is connected together by the cables, e.g. power cords. However, since the stage light control for the purpose of various light effects is more and more complicated, it is necessary to use a variety of signal cables for connecting each of the stage lights besides power cords. Thus, the entire cable configurations of the stage lights are too complicated so that the maintenance of the cables and equipments connected to the stage lights requires much time and work. Moreover, the size of light control desk is very large, that is, the hardware architecture of light control desk occupies larger area and thus the light control desk cannot be portable. Therefore, the available positions and areas on the platform for the stage lights are severely limited, which results in reducing the installation flexibility of the stage lights. Consequently, there is a need to develop a novel light control system to solve the aforementioned problems.

SUMMARY OF THE INVENTION

One objective of the present invention is to provide a wireless light control system with control apparatus and method thereof by simplifying the control architecture of stage light modules for effectively shrinking the size of light control apparatus of the wireless light control system to increase the portability of light control apparatus.

Another objective of the present invention is to provide a wireless light control system with control apparatus and method thereof for controlling the operation of stage light modules by the wireless transmission technique to solve the problem of conventional limited installation tasks of stage lights which is inconvenient for the usage of the stage light.

According to the above objectives, the present invention sets forth a wireless light control system with control apparatus and method thereof. The wireless light control system has a light control apparatus, stage light modules and power supply. The light control apparatus communicates with the receiving unit of stage light modules via a wireless communication link. The light control apparatus includes a controller, a wireless transmission module, a memory unit, an inputting device, a display unit and a setting interface. The wireless transmission module, memory unit, inputting device, display unit and setting interface respectively are coupled with the controller. The power supply provides the power to the light control apparatus.

The controller further includes a light-adjusting module, a scene generator, a procedure generator and a command-converting module. The light-adjusting module has a plurality of channel pages wherein each of the channel pages has a plurality of channels and corresponds to each of the stage light modules. The channels correspond to a plurality of light control parameters respectively to allow the light-adjusting module to adjust the light control parameters. Furthermore, the scene generator checks whether a plurality of scene fields has a plurality of scene setting parameters correspondingly for determining either waiting for a scene setting parameter generated by the scene generator for the scene field or storing the adjusted light control parameter into the scene field. The scene generator further combines some of the light control parameters for forming each of scene setting parameters. That is, each of scene setting parameters is composed of some light control parameters of some channels in the channel pages and is applicable to specific scene light environment.

Further, the scene generator utilizes the inputting device to switch the scene generator to either a scene storing mode or a scene loading mode. During the scene storing mode, the scene generator checks whether one of the scene fields has one of the scene setting parameters to determine that either the scene generator remains in the scene storing mode if there is a scene setting parameter for the scene field or the adjusted light control parameters are stored into the scene field if no scene setting parameter is for the scene field. During the scene loading mode, the scene generator checks whether one of the scene fields has one of the scene setting parameters to determine that either the scene generator loads the scene setting parameter from the memory unit to the scene field if there is a scene setting parameter for the scene field or the scene generator remains in the scene loading mode until a scene setting parameter is generated for the scene field if no scene setting parameter is for the scene field.

The procedure generator checks whether one of the scene fields has one of the scene setting parameters to determine that either the procedure generator generates a procedure configuration parameter if there is a scene setting parameter for the scene field or the procedure generator remains in a procedure configuration mode until a scene setting parameter is generated for the scene field if no scene setting parameter is for the scene field. The procedure generator checks whether the rest of procedure operation time duration of the procedure configuration parameter is greater than a predetermined time. If yes, the scene setting parameter is added to the procedure configuration parameter, and if not, the procedure generator remains in the procedure configuration mode. The procedure generator adjusts the operation time duration of the scene setting parameters by the inputting device to complete the addition of the scene setting parameter to the procedure configuration parameter. The procedure configuration parameters are applicable to a series of light status changes so that the procedure generator serially connects the scene setting parameters for forming a variety of light effects.

The command-converting module converts the light control parameters and the scene setting parameters into a plurality of light control commands and a plurality of scene control commands respectively based on a light control protocol. The command-converting module converts the procedure configuration parameter based on the light control protocol for forming a procedure control command. For example, the light control protocol is Digital Multiplex (DMX) protocol.

According to the above-mentioned descriptions, a wireless light control system with control apparatus and method thereof in the present invention simplifies the control architecture of stage light modules for effectively shrinking the size of light control apparatus to increase the portability of light control apparatus. Further, the present invention utilizes the wireless transmission technique of stage light modules to solve the problem of conventional limited installation tasks of stage lights which is inconvenient for the usage of the stage light.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
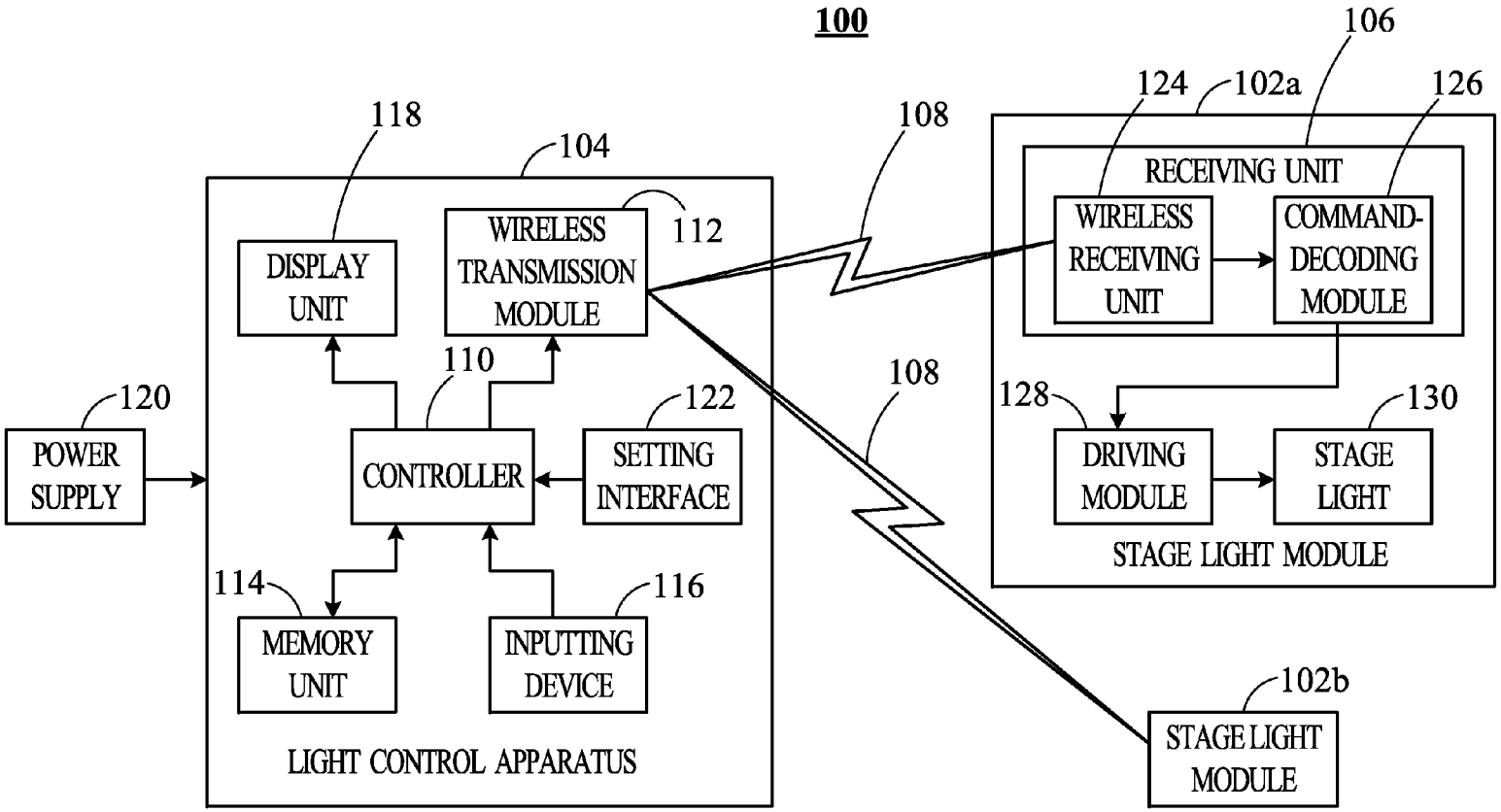
FIG. 1 is a schematic block diagram of a wireless light control system for stage lights according to one embodiment of the present invention.

FIG. 1 is a schematic block diagram of a wireless light control system 100 according to one embodiment of the present invention. The wireless light control system 100 controls a plurality of stage light modules 102*a*, 102*b* and includes a light control apparatus 104, stage light modules 102*a*, 102*b* and a power supply 120. The light control apparatus 104 communicates with the receiving unit 106 of stage light modules 102*a*, 102*b* via a wireless communication link 108. The light control apparatus 104 is electrically connected to the power supply 120. In the above case, two stage light modules 102*a*, 102*b* are employed. However, more than two stage light modules 102*a*, 102*b* can be applicable to the wireless light control system 100 wherein each of stage light modules 102*a*, 102*b* has an address which serves as the identification information of stage light modules 102*a*, 102*b* by the light control apparatus 104.

The light control apparatus 104 includes a controller 110, a wireless transmission module 112, a memory unit 114, an inputting device 116, a display unit 118 and a setting interface 122. The wireless transmission module 112, memory unit 114, inputting device 116, display unit 118 and setting interface 122 respectively are coupled with the controller 110. The setting interface 122 coupled with the controller 110 is capable of updating the control programs and calibrating the control parameters of the controller 110. The power supply 120 provides the power to the light control apparatus 104. For example, the power supply 120 may be battery or external power source. Preferably, the light control apparatus 104 is a portable control device.

The controller 110 generates light control command, scene control command and procedure control command for controlling the light effects, such as lighting on and off statuses, lighting on and off duration, brightness and color levels of the stage light modules 102*a*, 102*b*, and for identifying the addresses of stage light modules 102*a*, 102*b*. The controller 110 further converts light control parameters, scene control parameters and procedure control parameters according to light control protocol to allow light control commands, scene setting commands and procedure configuration commands to be compatible with the light control protocol, e.g. Digital Multiplex 512 (DMX512) protocol, or the like.

Figure 2:
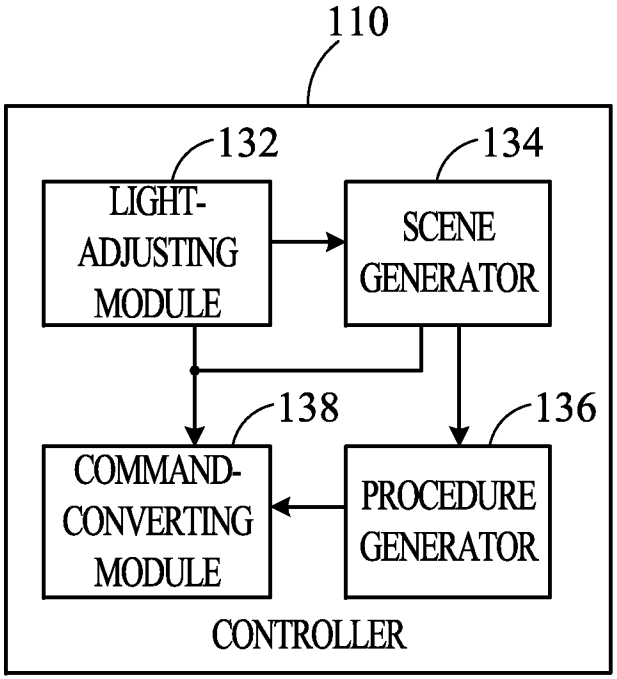
FIG. 2 is a detailed schematic block diagram of a controller of wireless light control system shown in FIG. 1 according to one embodiment of the present invention.

Please refer to FIG. 1 and FIG. 2. FIG. 2 is a detailed schematic block diagram of a controller 110 of wireless light control system 100 shown in FIG. 1 according to one embodiment of the present invention. The controller 110 further includes a light-adjusting module 132, a scene generator 134, a procedure generator 136 and a command-converting module 138. The light-adjusting module 132 is coupled with the scene generator 134 which is coupled with the procedure generator 136. The light-adjusting module 132, scene generator 134, and procedure generator 136 are coupled with the command-converting module 138, respectively.

The light-adjusting module 132 has a plurality of channel pages wherein each of the channel pages has a plurality of channels and corresponds to each of the stage light modules respectively. The channels correspond to a plurality of light control parameters respectively to allow the light-adjusting module 132 to adjust the magnitudes of the light control parameters. The light-adjusting module 132 checks whether more than one channel pages are selected to determine either simultaneously adjusting the light control parameters of the selected channel pages or adjusting the light control parameters of the selected channel pages respectively. Specifically, if more than one channel pages are selected, the light-adjusting module 132 simultaneously adjusts the light control parameters of the selected channel pages. If only one channel page at a time is selected, the light-adjusting module 132 adjusts the light control parameters of the selected channel pages respectively. Furthermore, the scene generator 134 checks whether a plurality of scene fields has a plurality of scene setting parameters correspondingly for determining either waiting for a scene setting parameter generated by the scene generator 134 for the scene field or storing the adjusted light control parameter into the scene field. The scene generator 134 further combines some of the light control parameters for forming each of scene setting parameters. That is, each of scene setting parameters is composed of some light control parameters of some channels in the channel pages and is applicable to specific scene light environment.

In one embodiment, the light-adjusting module 132 includes twelve channel pages which can be displayed on the display unit 118 wherein each of channel page having twelve channels corresponds one of stage light modules 102*a*, 102*b*. For example, when the light control apparatus 104 simultaneously adjusts the brightness of stage light modules 102*a*, 102*b*, the light-adjusting module 132 modifies the first channel values corresponding to the first channel page (mapped to stage light module 102*a*) by adjusting the brightness parameter for changing the luminance of stage light modules 102*a*, 102*b*. The first channel value of the second channel page (mapped to stage light module 102*b*) is also adjusted according to the above-mentioned manner with respect to the first channel page.

Similarly, the light-adjusting module 132 adjusts the second channel value of the first channel page corresponding to the stage light modules 102*a*, 102*b* by using the parameter of lighting on and off duration for changing the lighting on and off duration value. Further, the second channel value of the second channel page (mapped to stage light module 102*b*) is also be adjusted. The light-adjusting module 132 adjusts the third channel value of the first channel page corresponding to the stage light modules 102*a*, 102*b* by using the parameter of light colors for changing the color levels of stage light modules 102*a*, 102*b*. Further, the third channel value of the second channel page (mapped to stage light module 102*b*) is also be adjusted. The light-adjusting module 132 adjusts the fourth channel value of the first channel page corresponding to the stage light modules 102*a*, 102*b* by using the parameter of lighting on and off status for changing the on/off status of stage light modules 102*a*, 102*b* to determine the lighting on and off status. Further, the fourth channel value of the second channel page (mapped to stage light module 102*b*) is also be adjusted. In other words, the parameters of lighting on and off status, lighting on and off duration, brightness and colors of the stage light modules are respectively mapped to a channel. On condition that the light-adjusting module 132 of controller 110 adjusts the parameters, the lighting on and off status, lighting on and off duration, brightness and color levels of the stage light modules 102*a*, 102*b* can be adjusted by corresponding channels respectively.

Further, the scene generator 134 utilizes the inputting device 116 to switch the scene generator 134 to either a scene storing mode or a scene loading mode. During the scene storing mode, the scene generator 134 checks whether one of the scene fields has one of the scene setting parameters to determine that either the scene generator 134 remains in the scene storing mode if there is a scene setting parameter for the scene field or the adjusted light control parameters are stored into the scene field if no scene setting parameter is for the scene field. During the scene loading mode, the scene generator 134 checks whether one of the scene fields has one of the scene setting parameters to determine that either the scene generator 134 loads the scene setting parameter from the memory unit 114 to the scene field if there is a scene setting parameter for the scene field or the scene generator 134 remains in the scene loading mode until a scene setting parameter is generated for the scene field if no scene setting parameter is for the scene field.

The procedure generator 136 checks whether one of the scene fields has one of the scene setting parameters to determine that either the procedure generator 136 generates a procedure configuration parameter if there is a scene setting parameter for the scene field or the procedure generator 136 remains in a procedure configuration mode until a scene setting parameter is generated for the scene field if no scene setting parameter is for the scene field. The procedure generator 136 checks whether the rest of procedure operation time duration of the procedure configuration parameter is greater than a predetermined time and if yes, the scene setting parameter is added to the procedure configuration parameter, and if not, the procedure generator 136 remains in the procedure configuration mode. The procedure generator 136 adjusts the operation time duration of the scene setting parameters by the inputting device 116 to complete the addition of the scene setting parameter to the procedure configuration parameter. The procedure configuration parameters are applicable to a series of light status changes by serially connecting the scene setting parameters for forming a variety of light effects.

The command-converting module 138 converts the light control parameters and the scene setting parameters into a plurality of light control commands and a plurality of scene control commands respectively based on a light control protocol. The command-converting module 138 converts the procedure configuration parameter based on the light control protocol for forming a procedure control command.

The controller 110 of the light control apparatus 104 integrates the light-adjusting module 132, scene generator 134, procedure generator 136 and command-converting module 138 for effectively shrinking the size of light control apparatus 104. For example, the light-adjusting module 132, scene generator 134, and procedure generator 136 may be software programs, firmware programs, and/or hardware circuits. In one embodiment, the display unit 118 is capable of displaying the channel page of light-adjusting module 132, scene generator 134, and procedure generator 136. That is, the display unit 118 functions as multiple page display for further reducing the size of the light control apparatus 104 in the wireless light control system 100.

Please refer to FIG. 1 again. The wireless transmission module 112 transmits light control command, a scene control command and the procedure control command of the stage light modules 102*a*, 102*b* based on wireless transmission protocol, e.g. radio frequency transmission protocol. The memory unit 114 is used to store the light control parameters, the scene setting parameters and procedure configuration parameter. In one embodiment, the memory unit 114 may be non-volatile memory, e.g. flash memory. The inputting device 116 is used to input the light control parameters to the controller 110 for inputting light control parameters by keyboard and/or touching the display unit 118. The display unit 118 displays the light control parameters, the channel page and the channels of the light control commands, displays the scene setting parameters of the scene control commands, and the procedure configuration parameters of the procedure control command. For example, the display unit 118 may be liquid crystal display (LCD) and/or light-emitted diode (LED) display panel, or any type of display devices.

Each of receiving units 106 corresponding to the stage light modules 102*a*, 102*b* respectively includes a wireless receiving unit 124 and a command-decoding module 126. The wireless receiving unit 124 is coupled with the command-decoding module 126 which is coupled with the driving module 128. The driving module 128 drives the stage lights 130. In one embodiment, the power provided to the receiving units 106 is supplied by the batter and/or external power source. As shown in FIG. 1, each of receiving units 106 is built in each of stage light modules 102*a*, 102*b* correspondingly. In another case, each of receiving units 106 is connected to each of stage light modules 102*a*, 102*b* correspondingly by external cables.

The wireless transmission module 112 transmits a light control command, a scene control command and the procedure control command based on radio frequency transmission protocol. The wireless receiving unit 124 receives the light control commands, the scene control commands and the procedure control command based on the wireless transmission protocol. The command-decoding module 126 decodes the light control commands, the scene control commands and the procedure control commands for generating driving command based on the light control protocol. In one embodiment, the stage light modules 102*a*, 102*b* utilizes the driving module 128 to perform the driving command for controlling the light effects of stage light modules, such as lighting on and off status, lighting on and off duration, brightness and color levels of the stage lights 130.

According to above-mentioned descriptions, the light control apparatus 104 integrates the light-adjusting module 132, scene generator 134, procedure generator 136 and command-converting module 138 into the controller 110 for effectively shrinking the size of light control apparatus 104 of the wireless light control system 100 to increase the portability of light control apparatus 104 so that the control architecture of stage light modules 102*a*, 102*b* are effectively simplifies. That is, the light control apparatus 104 utilized the integrated the light control apparatus 104 and the controller 110 to operate the stage light modules 102*a*, 102*b* anytime and anywhere regardless of the limited installation tasks and arrangement of stage lights.

Further, the wireless light control system 100 utilizes the wireless transmission module 112 of light control apparatus 104 to transmit the light control command, scene control command and procedure control command. Additionally, the wireless light control system 100 utilizes the wireless receiving unit 124 of receiving unit 106 receives the light control command, scene control command and procedure control command from light control apparatus 104 to solve the problem, which affects the stage arrangement, of conventional cable connection between the light control desk and stage light modules.

Figure 3A:
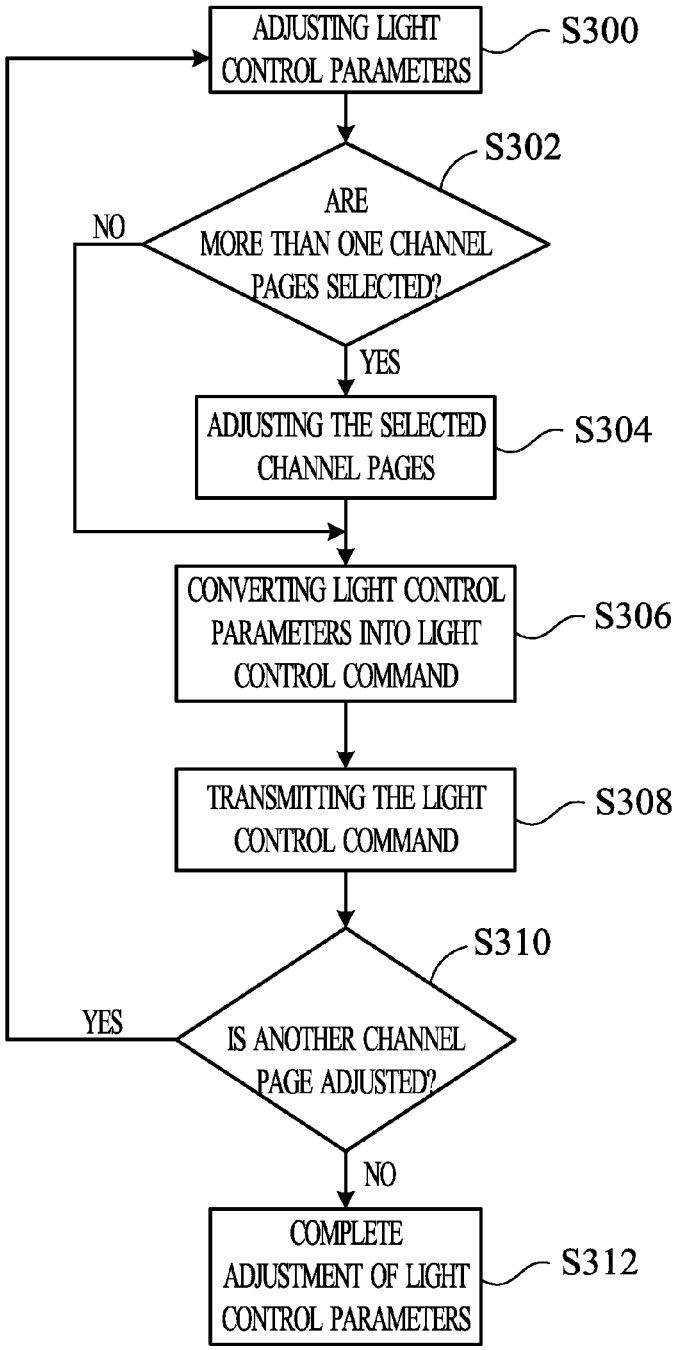
FIGS. 3A-3C are flow charts of wireless light control method according to one embodiment of the present invention.
Figure 3B:
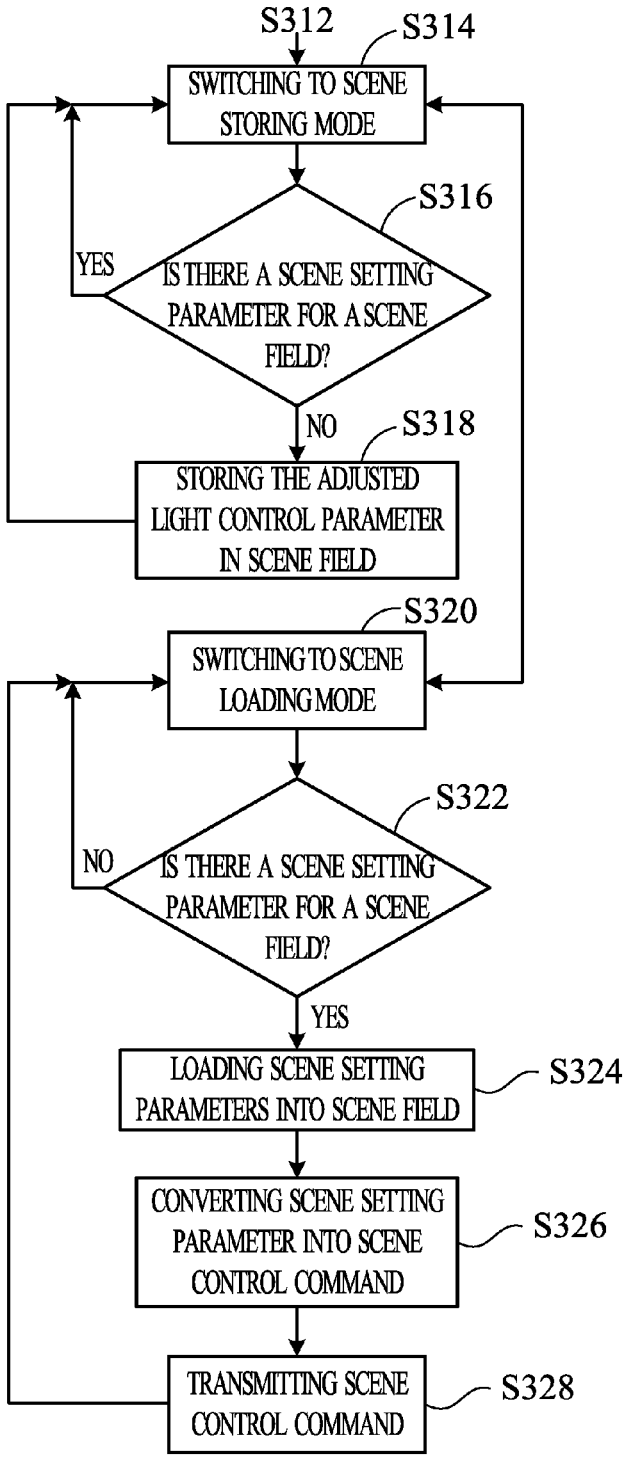
Figure 3C:
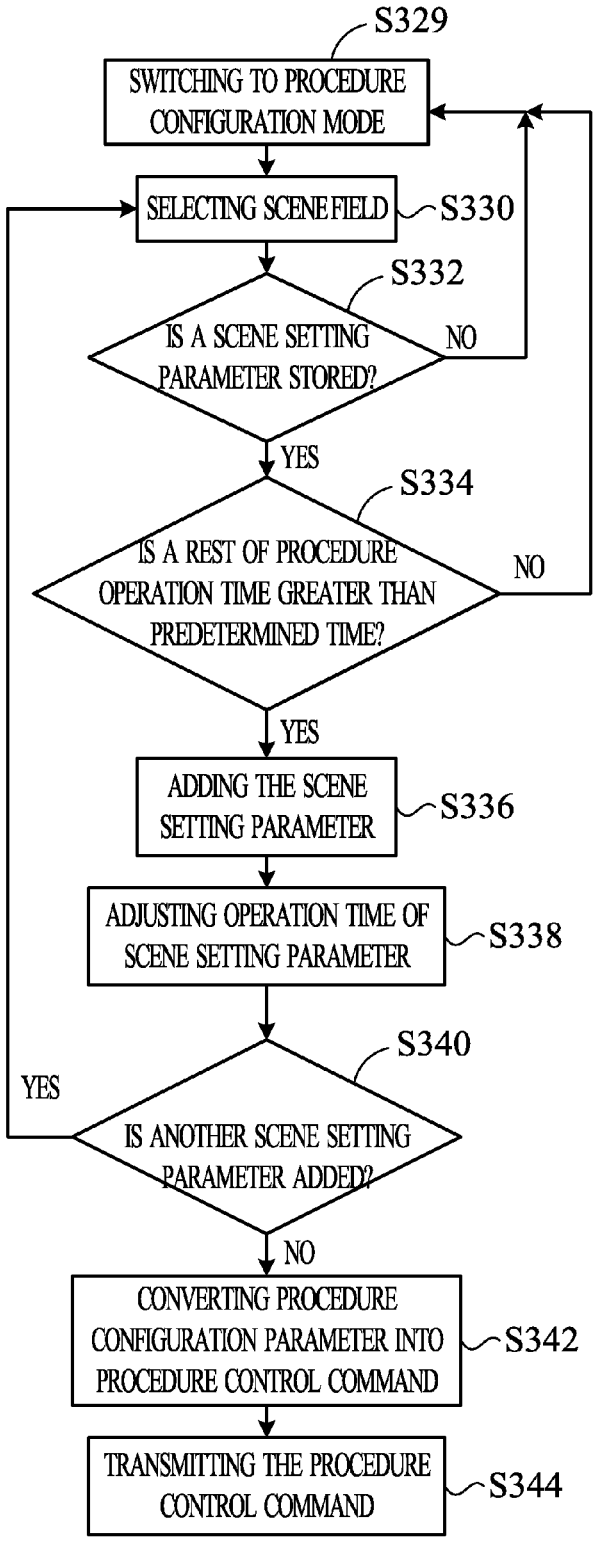

Please refer to FIGS. 1-2 and FIG. 3A-3C. FIGS. 3A-3C are flow charts of wireless light control method according to one embodiment of the present invention. A wireless light control method controls a plurality of stage light modules 102*a*, 102*b* in a wireless light control system 100. The wireless light control system 100 has a light control apparatus 104 and the stage light modules 102*a*, 102*b*, and the light control apparatus 104 further includes a controller 110, a wireless transmission module 112, a memory unit 114, an inputting device 116, a display unit 118 and a setting interface 122. The receiving unit 106 includes a wireless receiving unit 124 and a command-decoding module 126.

The controller 110 further includes a light-adjusting module 132, a scene generator 134, a procedure generator 136 and a command-converting module 138, and wherein the light-adjusting module 132 has a plurality of channel pages, each of the channel pages having a plurality of channels corresponds to each of the stage light modules 102*a*, 102*b*, the channels correspond to a plurality of light control parameters respectively. The method includes the following steps.

In step S300, the light-adjusting module 132 adjusts the light control parameters of one channel page via the inputting device 116.

In step S302, the light-adjusting module 132 checks whether more than one channel pages are selected. If yes, proceed to step S304, and if not, proceed to step S306.

In step S304, the light-adjusting module 132 adjusts the channels of the selected channel pages via the inputting device 116 for simultaneously adjusting the light control parameters of the channels of the selected channel pages, and proceed to step S306.

In step S306, the command-converting module 138 converts the light control parameters into a light control command based on a light control protocol. For example, the light control protocol is Digital Multiplex 512 (DMX512) protocol.

In step S308, the wireless transmission module 112 transmits the light control command to the stage light modules 102*a*, 102*b* based on a wireless transmission protocol for controlling the light effects of the stage lights. For example, the wireless transmission protocol is radio frequency transmission protocol.

In step S310, the light-adjusting module 132 check whether the light control parameters of another channel page are adjusted. If yes, return to step S300 until the light control parameters of another channel page are adjusted completely, and if not, proceed to step S312 to adjust the light control parameters completely.

As shown in FIG. 3B, after the step S312, further including the following steps:

In step S314, the scene generator 134 is switched to a scene storing mode by the inputting device 116, wherein the scene generator 134 has a plurality of scene fields corresponding to a plurality of memory sectors of the memory unit 114.

In step S316, the scene generator 134 checks whether one of the scene fields has a scene setting parameter. If yes, return to step S314 so that the scene generator 134 remains in the scene storing mode, and if not, proceed to step S318, wherein the scene setting parameter is composed of some light control parameters of the channel pages.

In step S318, the scene generator 134 stores the adjusted light control parameters of the channel pages into the scene field and returns to step S314.

In step S320, the inputting device 116 switches the scene generator 134 from the scene storing mode to a scene loading mode.

In step S322, the scene generator 134 checks whether a scene setting parameter is generated by the scene generator 134 for the scene field. If yes, proceed to S324, and if not, return to step S320 to allow the scene generator 134 to remain in the scene loading mode until a scene setting parameter is generated for the scene field. Steps S316 and S322 are used to identify whether a scene setting parameter is for the scene field in the scene loading mode and scene storing mode.

In step S324, the scene generator 134 loads the scene setting parameters to the scene field.

In step S326, the command-converting module 138 converts the scene setting parameters based on a light control protocol for forming a scene control command.

In step S328, the wireless transmission module 112 transmits the scene control command to the stage light modules 102*a*, 102*b* according to a wireless transmission protocol for controlling the light effects of the stage light modules 102*a*, 102*b*, and returns to step S320.

As shown in FIG. 3C, after the step S328, further including the following steps:

In step S329, the inputting device 116 switches the procedure generator 136 to be in the procedure configuration mode.

In step S330, the inputting device 116 selects a scene field.

In step S332, the procedure generator 136 checks whether the scene field has a scene setting parameter. If yes, proceed to step S334, and if not, return to step S329 so that the procedure generator 136 remain in the procedure configuration mode until a scene setting parameter is generated for the scene field.

In step S334, the procedure generator 136 checks whether a rest of procedure operation time duration of the procedure configuration parameter is greater than a predetermined time. If yes, proceed to step S336, and if not, return to step S329 so that the procedure generator 136 remains in the procedure configuration mode.

In step S336, the scene setting parameter is added to the procedure configuration parameter.

In step S338, the inputting device 116 adjusts the operation time duration of scene setting parameter to complete the addition of the scene setting parameter to the procedure configuration parameter.

In step S340, the procedure generator 136 checks whether another scene setting parameter is continuously added to the procedure configuration parameter. If yes, return to step S330, and if not, proceed to step S342.

In step S342, the command-converting module 138 converts the procedure configuration parameter into a procedure control command based on light control protocol.

In step S344, the wireless transmission module 112 transmits the procedure control command to the stage light modules 102*a*, 102*b* based on wireless transmission protocol for controlling the light effects of the stage light modules 102*a*, 102*b*.

According to the above-mentioned steps S300 through S344, the light control apparatus 104 integrates the light-adjusting module 132, scene generator 134, procedure generator 136 and command-converting module 138 into the controller 110 for effectively shrinking the size of light control apparatus 104 of the wireless light control system 100 to increase the portability of light control apparatus 104 so that the control architecture of stage light modules 102*a*, 102*b* are effectively simplifies.

Therefore, the light control apparatus integrates the light-adjusting module, scene generator, procedure generator and command-converting module into the controller for effectively shrinking the size of light control apparatus of the wireless light control system to increase the portability of light control apparatus so that the control architecture of stage light modules are effectively simplifies. Further, in the wireless light control system with control apparatus and method thereof, the light control apparatus utilizes the wireless transmission module to transmit the light control parameters of lighting on and off status, lighting on and off duration, brightness and color levels of the stage light modules. Additionally, the wireless light control system utilizes the wireless receiving unit of receiving unit to receive the light control command, scene control command and procedure control command from light control apparatus to solve the problem of conventional limited installation tasks of stage lights which is inconvenient for the usage of the stage light.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A wireless light control system with a control apparatus for controlling a plurality of stage light modules, the wireless light control system comprising:

a light control apparatus, comprising:

a controller having a light-adjusting module, a scene generator and a command-converting module, wherein the light-adjusting module has a plurality of channel pages, each of the channel pages having a plurality of channels corresponds to each of the stage light modules, and the channels correspond to a plurality of light control parameters respectively to allow the light-adjusting module to adjust the light control parameters, wherein the scene generator checks whether a plurality of scene fields has a plurality of scene setting parameters correspondingly for determining either waiting for a scene setting parameter generated by the scene generator for the scene field or storing the adjusted light control parameter into the scene field, and the scene generator further combines some of the light control parameters for forming each of scene setting parameters, and wherein the command-converting module converts the light control parameters and the scene setting parameters into a plurality of light control commands and a plurality of scene control commands respectively based on a light control protocol;

a wireless transmission module, coupled with the controller, transmitting the light control commands and the scene control commands to the stage light modules according to a wireless transmission protocol;

a memory unit, coupled with the controller, storing the light control parameters and the scene setting parameters; and a display unit, coupled with the controller, displaying the light control parameters of the light control commands, the channel pages and the channels, and displaying the scene setting parameters of the scene control commands; and a plurality of receiving units coupled with the light control apparatus respectively and corresponding to the stage light modules respectively, receiving the light control commands and the scene control commands for driving the stage light modules.

2. The wireless light control system of claim 1, wherein the light-adjusting module checks whether more than one channel pages are selected to determine either simultaneously adjusting the light control parameters of the selected channel pages or adjusting the light control parameters of the selected channel pages respectively.

3. The wireless light control system of claim 1, wherein the light control apparatus further comprises an inputting device, coupled with the controller, switching the scene generator to either a scene storing mode or a scene loading mode.

4. The wireless light control system of claim 3, wherein during the scene storing mode, the scene generator checks whether one of the scene fields has one of the scene setting parameters to determine that either the scene generator remains in the scene storing mode if there is a scene setting parameter for the scene field or the adjusted light control parameters are stored into the scene field if no scene setting parameter is for the scene field.

5. The wireless light control system of claim 3, wherein during the scene loading mode, the scene generator checks whether one of the scene fields has one of the scene setting parameters to determine that either the scene generator loads the scene setting parameter from the memory unit to the scene field if there is a scene setting parameter for the scene field or the scene generator remains in the scene loading mode until a scene setting parameter is generated for the scene field if no scene setting parameter is for the scene field.

6. The wireless light control system of claim 3, wherein the light control apparatus further comprises a procedure generator, coupled with the scene generator, serially connecting the scene setting parameters for forming a variety of light effects.

7. The wireless light control system of claim 6, wherein the procedure generator checks whether one of the scene fields has one of the scene setting parameters to determine that either the procedure generator generates a procedure configuration parameter or the procedure generator remains in a procedure configuration mode until a scene setting parameter is generated for the scene field.

8. The wireless light control system of claim 7, wherein the procedure generator checks whether a rest of procedure operation time duration of the procedure configuration parameter is greater than a predetermined time, and if yes, the scene setting parameter is added to the procedure configuration parameter, and if not, the procedure generator remains in the procedure configuration mode.

9. The wireless light control system of claim 8, wherein the inputting device adjusts the operation time duration of the scene setting parameters to complete the addition of the scene setting parameter to the procedure configuration parameter.

10. The wireless light control system of claim 7, wherein the command-converting module converts the procedure configuration parameter into a procedure control command based on the light control protocol and the wireless transmission module transmits the procedure control command to the stage light modules based on the wireless transmission protocol for controlling the light effects of the stage light modules.

11. The wireless light control system of claim 1, wherein each of the receiving units further comprises:

a wireless receiving unit, coupled with the wireless transmission module, receiving the light control parameters of the light control commands and the scene setting parameters of the scene control commands based on the wireless transmission protocol; and a command-decoding module, coupled with the wireless receiving unit, decoding the light control commands and the scene control commands based on the light control protocol for driving the stage light modules.

12. The wireless light control system of claim 1, wherein the light control protocol is Digital Multiplex 512 (DMX512) protocol.

13. The wireless light control system of claim 1, wherein the light control parameters is selected from one group consisting of a lighting on and off value, a lighting on and off duration value, a brightness value, a light colors, an address value and the combination thereof.

14. A wireless light control method for controlling a plurality of stage light modules in a wireless light control system, wherein the wireless light control system has a light control apparatus and the stage light modules, wherein the light control apparatus further comprises a controller, a wireless transmission module, a memory unit, an inputting device and a display unit, wherein the controller further comprises a light-adjusting module, a scene generator, a procedure generator and a command-converting module, and wherein the light-adjusting module has a plurality of channel pages, each of the channel pages having a plurality of channels corresponds to each of the stage light modules, and the channels correspond to a plurality of light control parameters respectively, the method comprising the steps of:

(a) adjusting the light control parameters of one channel page by the light-adjusting module via the inputting device;

(b) converting the light control parameters into a light control command based on a light control protocol by the command-converting module;

(c) transmitting the light control command to the stage light modules based on a wireless transmission protocol for controlling a plurality of light effects of the stage light modules by the wireless transmission module;

(d) checking whether the light-adjusting module adjusts the light control parameters of another channel page, wherein if yes, return to step (a) until the light control parameters of another channel page are adjusted completely, and if not, completely adjusting the light control parameters;

(e) switching the scene generator to a scene storing mode by the inputting device, wherein the scene generator has a plurality of scene fields corresponding to a plurality of memory sectors of the memory unit;

(f) checking whether one of the scene fields has a scene setting parameter by the scene generator, wherein if yes, return to step (e) and the scene generator remains in the scene storing mode, and if not, proceed to step (g), and wherein the scene setting parameter is composed of some light control parameters of the channel pages; and (g) storing the adjusted light control parameters of the channel pages into the scene field and returning to step (e).

15. The wireless light control method of claim 14, after the step (a), further comprising the steps of:

(a1) checking whether more than one channel pages are selected by the light-adjusting module, wherein if yes, proceed to step (a2), and if not, proceed to step (b); and (a2) adjusting the channels of the selected channel pages by the light-adjusting module via the inputting device for simultaneously adjusting the light control parameters of the channels of the selected channel pages, and proceeding to step (b).

16. The wireless light control method of claim 14, after the step (g), further comprising the steps of:

(g1) switching the scene generator from the scene storing mode to a scene loading mode by the inputting device;

(g2) checking whether one scene setting parameter is generated by the scene generator for the scene field, wherein if yes, proceed to (g3), and if not, return to step (g1) to allow the scene generator to remain in the scene loading mode until the scene setting parameter is generated for the scene field;

(g3) loading the scene setting parameters to the scene field by the scene generator;

(g4) converting the scene setting parameters based on a light control protocol for forming a scene control command by the command-converting module; and (g5) transmitting the scene control command to the stage light modules according to a wireless transmission protocol for controlling the light effects of the stage light modules, and returning to step (g1).

17. The wireless light control method of claim 16, after the step (g5), further comprising the steps of:

(h1) switching the procedure generator to be in a procedure configuration mode by the inputting device;

(h2) selecting one scene field by the inputting device;

(h3) checking whether the scene field has a scene setting parameter by the procedure generator, wherein if yes, proceed to step (h4), and if not, return to step (h1) so that the procedure generator remains in the procedure configuration mode until a scene setting parameter is generated for the scene field;

(h4) checking whether a rest of procedure operation time duration of the procedure configuration parameter is greater than a predetermined time wherein if yes, proceed to step (h5), and if not, the procedure generator remains in the procedure configuration mode;

(h5) adding the scene setting parameter to the procedure configuration parameter; and (h6) adjusting the operation time duration of scene setting parameter by the inputting device to complete the addition of the scene setting parameter to the procedure configuration parameter.

18. The wireless light control method of claim 17, after the step (h6), further comprising the steps of:

(h7) checking whether another scene setting parameter is continuously added to the procedure configuration parameter by the procedure generator, wherein if yes, return to step (h2), and if not, proceed to step (h8);

(h8) converting the procedure configuration parameter into a procedure control command based on light control protocol by the command-converting module; and (h9) transmitting the procedure control command to the stage lights based on wireless transmission protocol for controlling the light effects of the stage light modules by the wireless transmission module.

19. The wireless light control method of claim 14, wherein the light control protocol is Digital Multiplex 512 (DMX512) protocol.

20. The wireless light control method of claim 14, wherein the light control parameters are selected from one group consisting of a lighting on and off value, a lighting on and off duration value, a brightness value, a light colors, an address value and the combination thereof.

* * * * *